US007264288B2

(12) United States Patent
Goubot et al.

(10) Patent No.: US 7,264,288 B2
(45) Date of Patent: Sep. 4, 2007

(54) BARREL HANDLING DEVICE

(75) Inventors: Jean-Marc Goubot, Pont Saint Esprit (FR); Robert Faure, Bourg Saint Andeol (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 10/534,539

(22) PCT Filed: Sep. 1, 2004

(86) PCT No.: PCT/FR2004/050407

§ 371 (c)(1),
(2), (4) Date: May 12, 2005

(87) PCT Pub. No.: WO2005/028355

PCT Pub. Date: Mar. 31, 2005

(65) Prior Publication Data

US 2006/0119117 A1 Jun. 8, 2006

(30) Foreign Application Priority Data

Sep. 2, 2003 (FR) ..... 0350489

(51) Int. Cl.
*A47G 21/10* (2006.01)

(52) U.S. Cl. ..... 294/2; 294/64.1

(58) Field of Classification Search ..... 294/2, 294/64.1, 103.1, 119.1, 906, 93, 94
See application file for complete search history.

(56) References Cited

U.S. PATENT DOCUMENTS

| | | | | |
|---|---|---|---|---|
| 2,783,078 | A | 2/1957 | Billner | |
| 3,383,286 | A * | 5/1968 | Paget | 376/269 |
| 3,785,691 | A * | 1/1974 | Sperry | 294/64.1 |
| 4,151,983 | A | 5/1979 | Stock et al. | |
| 4,753,004 | A * | 6/1988 | Fujioka | 29/740 |
| 4,850,627 | A | 7/1989 | Franklin | |
| 5,127,692 | A * | 7/1992 | Yakou et al. | 294/2 |
| 5,310,304 | A | 5/1994 | Baumgartner | |
| 5,752,729 | A * | 5/1998 | Crozier et al. | 294/2 |

FOREIGN PATENT DOCUMENTS

| | | |
|---|---|---|
| DE | 240 449 | 11/1911 |
| DE | 36 36 016 | 5/1988 |
| EP | 0 633 215 | 1/1995 |

* cited by examiner

*Primary Examiner*—Gene O. Crawford
*Assistant Examiner*—Esther O. Okezie
(74) *Attorney, Agent, or Firm*—Oblon, Spivak, McClelland, Maier & Neustadt, P.C.

(57) ABSTRACT

A grab for lifting barrels stored in a well includes a grasp system provided for example with suction caps for slightly raising a barrel and movable arms provided with extendable fingers used for embracing the barrel and forming a solid support therefore. The elements are provided with cameras and optical fibers to illuminate and inspect the barrel before lifting it. The grab is provided with a mechanism for centering it on the barrel. The grab can be used for processing nuclear fuels.

7 Claims, 4 Drawing Sheets

BARREL HANDLING DEVICE

The subject of this invention is a barrel handling device, normally of cylindrical or very similar shape, to grasp barrels, to lift barrels, and if necessary, to inspect barrels, Certain dangerous waste substances are poured into metal barrels to be stored for long periods of time. This is namely the case for irradiated products of the nuclear industry. Special techniques have been engineered to coat and to vitrify the waste before pouring it into the barrels, which are then held in a storage installation. They may nevertheless be moved at a later date, to be inspected or transported.

Many barrel handling devices have been designed. Said devices include various grasping means such as tongs or clamping jaws which are designed to grab one part of the barrel or another, but which generally present, the inconveniences of failing to provide a tight grip, being too big to be conveniently lowered into storage wells, not being resilient to the oscillating or tilting movements of the barrel once the latter has been raised and furthermore not offering the possibility to inspect the barrel before the latter is grasped and/or once it has been grasped. Yet, if a barrel is torn or cracked, it should not be moved so as to avoid further aggravating any leaks of the dangerous contents; and even if the barrel is intact, the known devices risk being handled inappropriately or dropping, which could result in the possibility of the barrel being broken.

The invention relates to a barrel handling device that unlike the aforementioned devices provides a firm grasp of the barrel, with no risk of the latter being released or being allowed to tilt in any way whilst being lifted. Moreover, the device can easily be fitted with means to enable thorough inspection of the surface of the barrel.

The document EP 0 633 215 describes a handling device which also offers the advantage of providing a good grasp of the barrel by means of tilting fingers that come under the lower periphery of the barrel, which is hence positioned on said fingers when it is lifted, but the positioning of the device around the barrel is far more problematic than with the invention.

In its most general form, the handling device comprises a system for grasping the upper surface of the barrel, at least one moveable arm that can be moved vertically in relation to the grasp system and next to the peripheral surface of the barrel, and a finger fitted under the arm that can be moved under the lower surface of the barrel. Hence, the barrel can first be grasped by its upper surface, slightly raised by the grasp system, the one or several arm(s) (there are usually several) are lowered next to the barrel, the finger is extended below the barrel and provides solid support thereof; the arm counteracts the lateral sliding movement of the barrel; and the grasp system is relieved although it continues to contribute to a stable grasp of the barrel.

Insofar as that to guarantee optimum grabbing results, the grab system comprises a centring mechanism provided with fingers that can be extended radially, for example towards a flange of the upper surface of the barrel. The grasp system is not adhered to the barrel until all of the fingers have touched the flange and have centred it; a favourable consequence is that each arm may be placed at a short distance from the barrel so as to secure it more firmly and ensure that the finger positions itself adequately under the barrel when it moves.

The device can be positioned correctly even if the barrel is difficult to access, at great depths or in a narrow well.

The means of inspecting the barrel may include means located under the arm, as well as means located within the grab system. These means allow to inspect the upper surface of the barrel and to provisionally decide whether it can be raised, said means also allowing to inspect the peripheral surface and then the lower surface of the barrel when the arm is lowered.

The invention will now be described with reference to the figures.

FIG. 1 gives a general view of the device,

Figure 1:
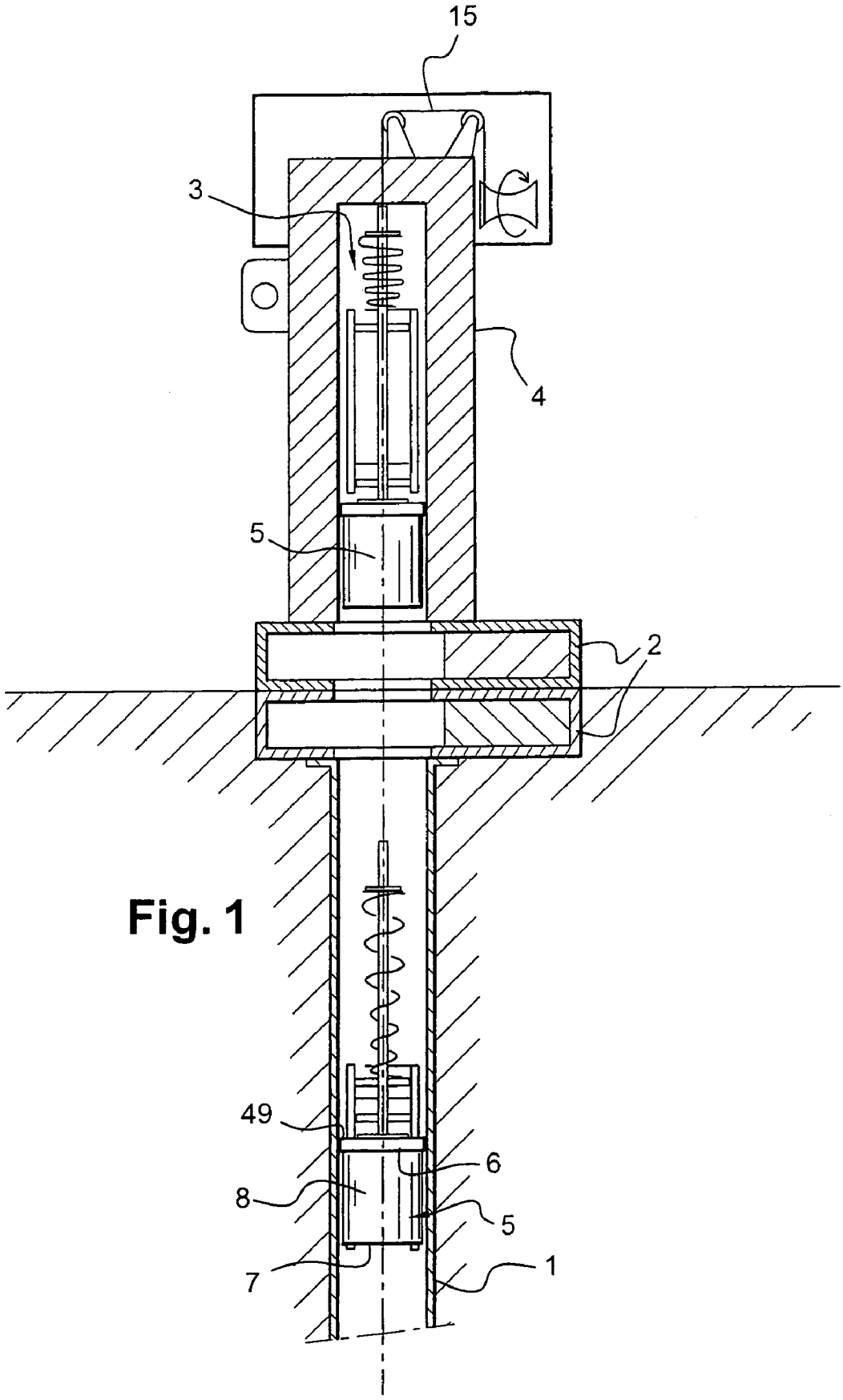
FIG. 1 is addressed.

In the embodiment described herein, the barrels are stored in wells 1 slightly larger than themselves.

Sliding units 2 normally closed isolate the wells 1 from the outside but are opened when a barrel needs to be stored or extracted. The device of the invention, which is hence used, comprises in particular a mechanical system which is movable in well 1 and that can lower or lift the barrel, hereinafter referred to as grab 3, as well as a transfer and protection hood 4 that absorbs the radiation emanating from the barrel and that lies on the well 1 opening during the storage or extraction operation. The hood 4 comprises a cavity which is large enough to accommodate the grab 3 loaded with the barrel. Other usual parts of the handling device are not mentioned hereafter. The invention focuses exclusively on grab 3.

The barrels 5 are generally cylindrical in shape and comprise an upper surface 6, a lower surface 7, a peripheral side surface 8; we can also thereof distinguish an upper ledge 48 jutting upwards around the upper surface 6 and which corresponds to the cover bezel in the surface ferrule. The ledge 49 can exist in another form when the cover is screwed on or welded, and can nevertheless provide the same grab centering function.

Figure 2:
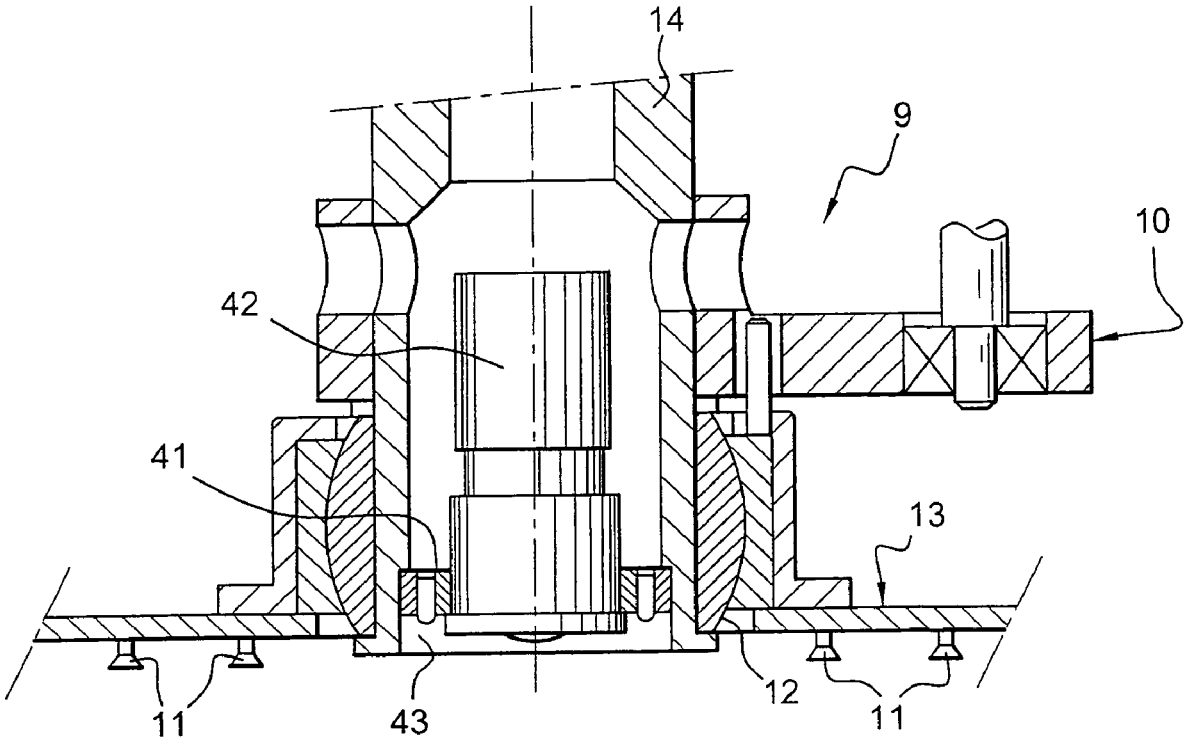
FIG. 2 shows some of the grasp means.
Figure 3:
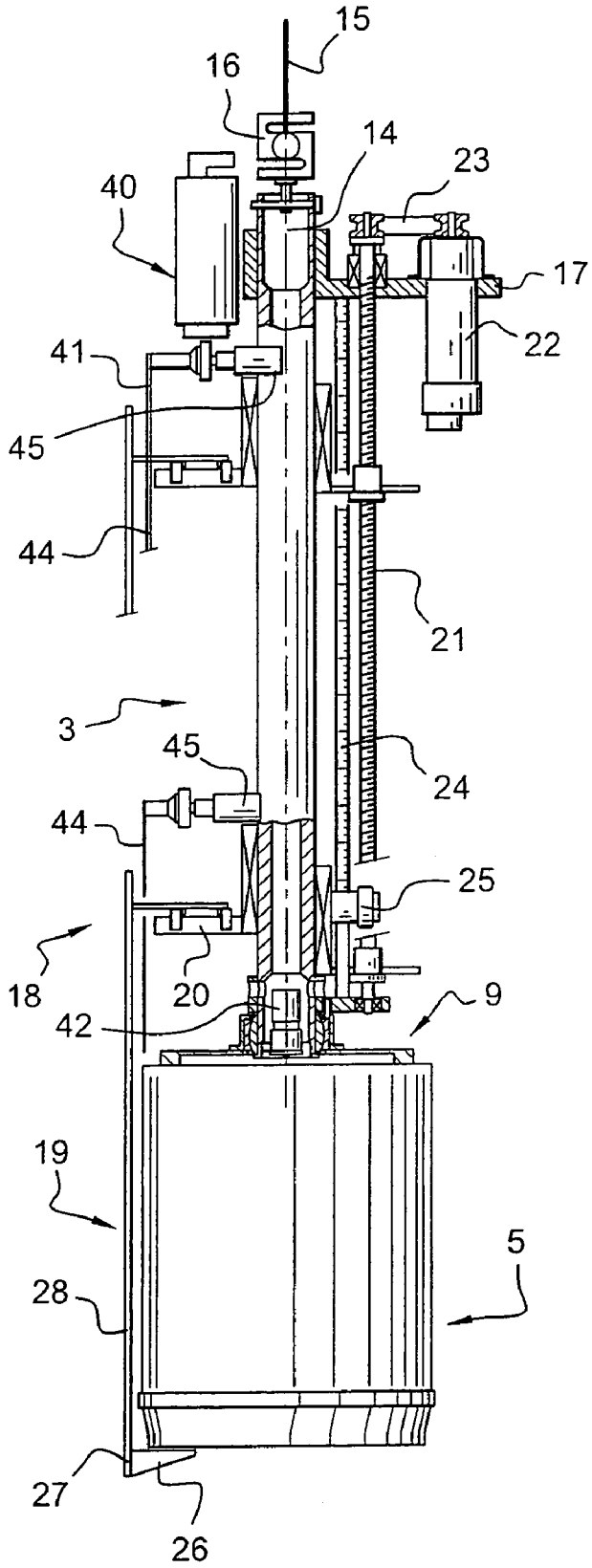
FIG. 3 is a general illustration of the grab.

We are now going to refer to FIG. 2. Grab 1 comprises several units, of which the first described is a grasp system 9 of the barrel 5 of which the purpose is to slightly raise said barrel before completing the handing procedure. It comprises a support 10, at least one suction cap 11 (a set of three suction caps arranged in a circle are shown here), as well as a ball and socket 12 linking the suction cap holder 13 to the support 10. By this means, the suction caps 11 can be applied to the upper surface 6 of the barrel 5 even if the latter is inclined, without the support 10 having to be tilted erratically. The rest of the description 3 is depicted in FIG. 3.

The ball and socket 12 and the support 10 are suspended from a column 14, itself suspended from a cable 15 manipulated from the outside by means of a strain sensor 16. The column 14 also bears an upper plate 17.

Figure 4:
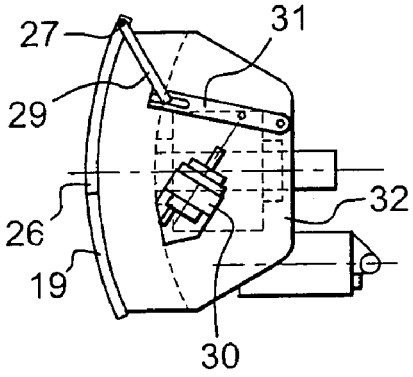
FIG. 4 shows the finger extension system.
Figure 5:
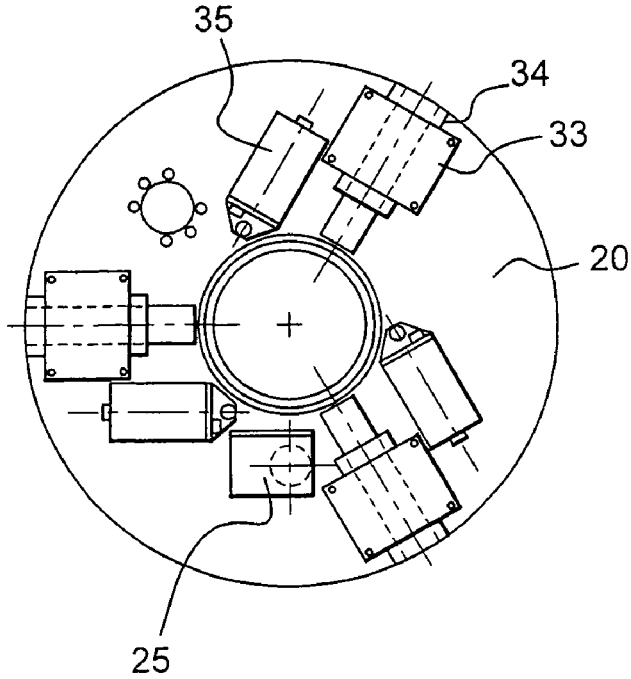
FIG. 5 shows the arrangement of this system.

Another element of the grab 3 is a barrel 5 hooking system 18 and which comprises at least one vertical arm 19 (a set of three arms 19 arranged in a circle are shown here, although only one is illustrated) suspended from a movable plate 20. The movable plate 20 slides across the column 14 by means of a recirculating ball screw 21 of which the upper and lower ends are retained in the upper plate 17 and the support 10. A gear motor 22 mounted on the upper plate 17 rotates the recirculating ball screw 21 by means of a belt drive 23. A graduated rule 24 is also mounted between the upper plate 17 and the support 10 parallel to the recirculating ball screw 21, and a position sensor 25 mounted on the movable plate 20 allows to monitor the vertical movements of said plate. The description hereafter refers to FIGS. 3, 4 and 5.

The arms 19 embrace the barrel 5, the radius of their circle being slightly bigger than that of the peripheral surface 8. Their height is also slightly bigger than that of the peripheral surface 8.

A finger 26 fitted under them moves under the lower surface 7 of the barrel once the grab 3 has been completely lowered. The fingers 26 extend between a folded position in which they tangentially stretch out, in the circle of the arms 19, and an active position in which they radially stretch out, under the barrel 5. They are mounted under the arms 19 by hinges 27 which allow them to rotate, and their rotational movement is controlled by means of a rod 28 which extends vertically up to the arm 19, where it ends in a lever 29 that a cylinder 30 rotates by means of a pull rod 31. Said last two elements are mounted on a support referred to as pantile 32, itself mounted on a guide carriage 33, which slides across a guide rail 34 of an appropriate section mounted on the movable plate 20. The pantile 32 and the guide carriage 33 are moved by a cylinder 35. The same device is present for each of the three arms 19, to allow for variation as required of the radius of the circle that they embrace. The grab 3 can hence be lowered into narrow wells or be adapted to barrels 5 of various diameters.

Figure 6:
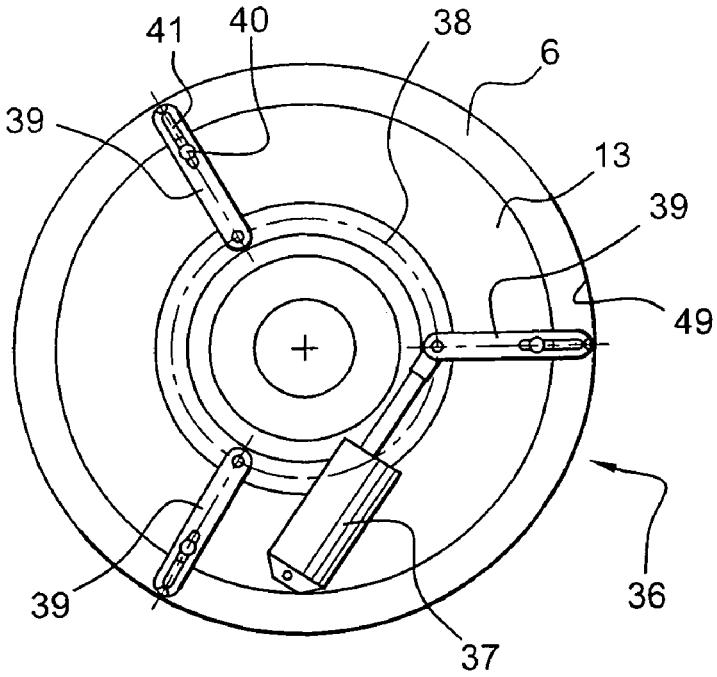
FIG. 6 shows the system used for centering the grab on the barrel.

Another element of the grab 3 is a centring device 36 illustrated in FIG. 6, mounted on the suction cap holder 13 and which comprises a cylinder 37, a crown 38 which rotates on the suction cap holder 13 and a set of three fingers 39 linked by one of the inner ends to the crown 38 and, by the middle, to the suction cap holder 13: the toggle link at these points is nevertheless movable and comprises a pivot 40 attached to the suction cap holder 13 and which can slide into a slit 41 made in the length of the finger 39.

Rotation of the crown 38 operated by the cylinder 37 modifies the orientation of the fingers 39 and the radial position of their outer end. Extension of the fingers 39 continues until all of them touch the ledge 49 of the barrel 5 and until the grasp system 9 and more particularly the barrel 5 hooking system 18 are centred.

Here is how the barrel 5 is grasped when it is in well 1 (the procedure would be identical in other locations). The grab 3 is lowered into well 1 until the grasp system 9 comes up to the upper surface 6. The centring system 36 is switched on, then the suction caps 11 are activated. The grab 3 is slightly raised to lift barrel 5. The hooking system 18 is thence switched on, the arms 19 are extended then lowered alongside the peripheral surface 8, and finally the fingers 26 are extended and the arms 19 are tightened. The barrel 5 is then firmly grasped and can be lifted without risking failure of the suction caps 11. It is to be noted that the fingers 26 hold the inner surface 7 of the barrel 5 if the latter is open and ajar.

An important aspect of the device mentioned hereinabove is the possibility to carry out inspections to decide whether the barrel 5 can be extracted without risk or damage. We will now go back to referring to FIG. 3. Lighting is provided by a light source 40 mounted on the upper plate 17 and illuminates the surface of the barrel 5 by means of a network of optical fibres 44. The images of the upper surface 6 of the barrel 5 are captured by a camera 42 (also refer to FIG. 2) mounted on the bottom of column 14 and directed downwards, forming an ring light source 43 which provides the necessary illumination of the upper surface 6 as the light is formed around said upper surface. The optical fibres 44 extend into each of the arms 19 until they come below the latter, and are also connected to endoscopes or fibrescopes 45 mounted onto the pantiles 32. It becomes possible to illuminate and inspect the peripheral surface 8 then the lower surface 7 as the arms are lowered alongside said peripheral surface and then under said lower surface.

Further embodiments of the device are possible. The suction caps 11 can for example be replaced by other electromagnetic or mechanical grasping means. The lighting system can function with micro-lamps or LEDs. The vision system integrated into the arm 19 can be directly integrated into the camera of a video-endoscope.

The invention claimed is:

1. A barrel grasping and lifting device, the barrel being substantially cylindrical and comprising a lower surface, an upper surface and a peripheral surface, the device comprising:

a group system for grasping the upper surface of the barrel, at least one moveable arm and a centering mechanism, the grasp system includes a support, and at least one suction cup mounted under the support for sucking the upper surface, the centering mechanism being mounted on said support and comprising fingers that can be extended radially, the movable arm being vertical and vertically slidable with respect to the support alongside the peripheral surface, and comprising a finger at a lower end of the arm, and means for moving said finger under the lower surface.

2. A barrel grasping and lifting device according to claim 1, wherein the grasp system is suspended from a column, the at least one moveable arm is suspended from a plate sliding along the column, and an elevator system adjusts the height of the plate of the column.

3. A barrel grasping and lifting device according to claim 2, wherein the plate comprises a carriage configured to slide radially, and from which the at least one moveable arm is suspended, and a carriage slide control.

4. A barrel grasping and lifting device according to claim 3, wherein the carriage comprises means for rotating the finger of the movable arm, said means for rotating comprising a rod located on the arm.

5. A barrel grasping and lifting device according to claim 1, further comprising a ball and socket for mounting said suction cap to said support.

6. A barrel grasping and lifting device according to claim 1, further comprising means for inspecting the barrel.

7. A barrel grasping and lifting device according to claim 6, wherein the means for inspecting the barrel comprises means located on the at least one moveable arm, and means located within the grasp system.

* * * * *